US006845286B2

(12) United States Patent
Hewitt

(10) Patent No.: US 6,845,286 B2
(45) Date of Patent: Jan. 18, 2005

(54) DETECTION OF ROLLER DAMAGE AND/ OR MISALIGNMENT IN CONTINUOUS CASTING OF METALS

(75) Inventor: Philip Neill Hewitt, Middlesbrough (GB)

(73) Assignee: Corus UK Limited, London (GB)

( * ) Notice: Subject to any disclaimer, the term of this patent is extended or adjusted under 35 U.S.C. 154(b) by 146 days.

(21) Appl. No.: 10/257,380

(22) PCT Filed: Apr. 18, 2001

(86) PCT No.: PCT/GB01/01739

§ 371 (c)(1),
(2), (4) Date: Oct. 18, 2002

(87) PCT Pub. No.: WO01/79588

PCT Pub. Date: Oct. 25, 2001

(65) Prior Publication Data

US 2003/0114997 A1 Jun. 19, 2003

(30) Foreign Application Priority Data

Apr. 18, 2000 (GB) ..... 0009428

(51) Int. Cl.[7] ..... B22D 11/16
(52) U.S. Cl. ..... 700/146; 164/451
(58) Field of Search ..... 73/593; 700/146; 164/451, 151.1, 151.3, 449.1

(56) References Cited

U.S. PATENT DOCUMENTS 6,289,971 B1 * 9/2001 Kagawa ..... 164/449.1
6,466,001 B2 * 10/2002 Hanazaki et al. ..... 324/76.21

FOREIGN PATENT DOCUMENTS

EP 0 776 708 A 4/1997

OTHER PUBLICATIONS

Patent Abstracts of Japan, vol. 1998, No. 12, Oct. 31, 1998, & JP 10 193053 A, (Sumitomo Metal Ind Ltd), Jul. 28, 1998.

Patent Abstracts of Japan, vol. 1998, No. 05, Apr. 30, 1998, & JP 10 005957 A (NKK Corp), Jan. 13, 1998.

Patent Abstracts of Japan, vol. 1999, No. 08, Jun. 30, 1999, & JP 11 077268 A (NKK Corp), Mar. 23, 1999.

Patent Abstracts of Japan, vol. 014, No. 478, Oct. 18, 1990, & JP 02 192863 A (Sumitomo Metal Ind Ltd), Jul. 30, 1990.

DATABASE WPI Section Ch, Week 199832, Derwent Publications Ltd., London, GB; AN 1998–370273, XP002181099 & JP 10 146658 A (Nippon Steel Corp), Jun. 2, 1998.

* cited by examiner

*Primary Examiner*—John E. Chapman
(74) *Attorney, Agent, or Firm*—Bacon & Thomas, PLLC

(57) ABSTRACT

A method for detecting roller irregularities during on-line continuous casting of a metal comprises; i) continuously monitoring the changes in the mould level over time; ii) identifying large periodic influences affecting the mould level versus time function and their frequency, iii) comparing the frequency of the periodic influences of step ii) with predicted frequency harmonics based on a normal operation of the casting process and highlighting by comparison of the predicted and actual frequencies characteristics indicative of irregularities in roller behavior.

8 Claims, 4 Drawing Sheets

DETECTION OF ROLLER DAMAGE AND/OR MISALIGNMENT IN CONTINUOUS CASTING OF METALS

This invention relates to continuous casting of metals and to the detection of roller malfunction or damage on-line.

The process of continuous casting is well known in the metal processing industry. Basically, this process involves the use of a high level mould for receiving the molten metal, the mould having an exit at its lower end from which the cast strand emerges and is carried by a roller conveyor from a vertical to a horizontal position, although some machines are wholly vertical. Water sprays may be used to cool the metal strand in the roller conveyor. The roller conveyor comprises a plurality of rollers arranged in pairs at a set distance apart which defines the thickness and/or depth of the cast strand. The process may run continuously for weeks at a time at high temperature with large volumes of cast metal running through the conveyor, thus there is considerable scope for damage, wear or movement of the rollers from their starting condition.

Any change in the diameter, circularity, linearity, eccentricity, alignment of a roll or failure of support bearings may lead to variations in the set distance between pairs of the rollers resulting in consequent variations in the thickness of the partially molten cast strand. Such changes in the distance between pairs of rollers can squeeze or expand the cast strand leading to distortions at the mould level which can lead to surface defects in the final product formed at the initial point of solidification. The pumping effect of intermittent squeezing and expansion on liquid metal in the cast strand can also lead to segregation, internal cracking and porosity problems in the centre of the strand.

Thus, it is desirable to monitor the condition of rollers and to maintain, where possible, a continuity in the geometry and alignment of the rollers both during and between castings. Existing methods for detecting irregularities in the rollers of a continuous casting machine are based on the use of a sensor head which is attached to the dummy bar and sent through the machine when it is off-line or at the start of cast, These sensors rely on contact with the surface of the rollers to provide information as to the geometry and/or alignment of the rollers. Examples of such methods and apparatus for performing these methods are known from prior published patents and applications GB 2 097125 A, U.S. Pat. Nos. 4,344,232, 4,361,962, 3,983,631 and 3,962,794.

A disadvantage of the prior published methods and apparatus is that they require the method to be carried out with the casting machine off-line and cold. This can result in considerable down time in the casting process thus increasing overhead costs. In addition, roller problems are often due to effects such as adhesion of particles to the rollers at high temperature or distortion at high temperature which cannot be detected off-line. As sequence lengths increase to times in the order of weeks the need for information during a sequence becomes more important.

The present invention seeks to alleviate these problems. In accordance with the present invention there is provided a method for detecting roller irregularities during on-line continuous casting of a metal comprising;

i) continuously monitoring the changes in the mould level over time;

ii) identifying large periodic influences affecting the mould level versus time function; and their frequency iii) comparing the frequency of the periodic influences of step ii) with predicted frequency harmonics based on a normal operation of the casting process and highlighting by comparison of the predicted and actual frequencies characteristics indicative of irregularities in roller behaviour.

The preferred means for identifying the large periodic influences in step ii) is by applying a mathematical transformation, preferably a Fourier transform, most preferably a Fast Fourier transform. This transform separates the complex mould signal enabling highlighting of periodic influences in the signal by separating out background noise, thus allowing easier identification of periodic and unexpected influences due to the asymmetric operation of a damaged or misaligned roller.

For the purposes of clarification, the invention will now be further described with reference to the following figures in which.

Figure 1:
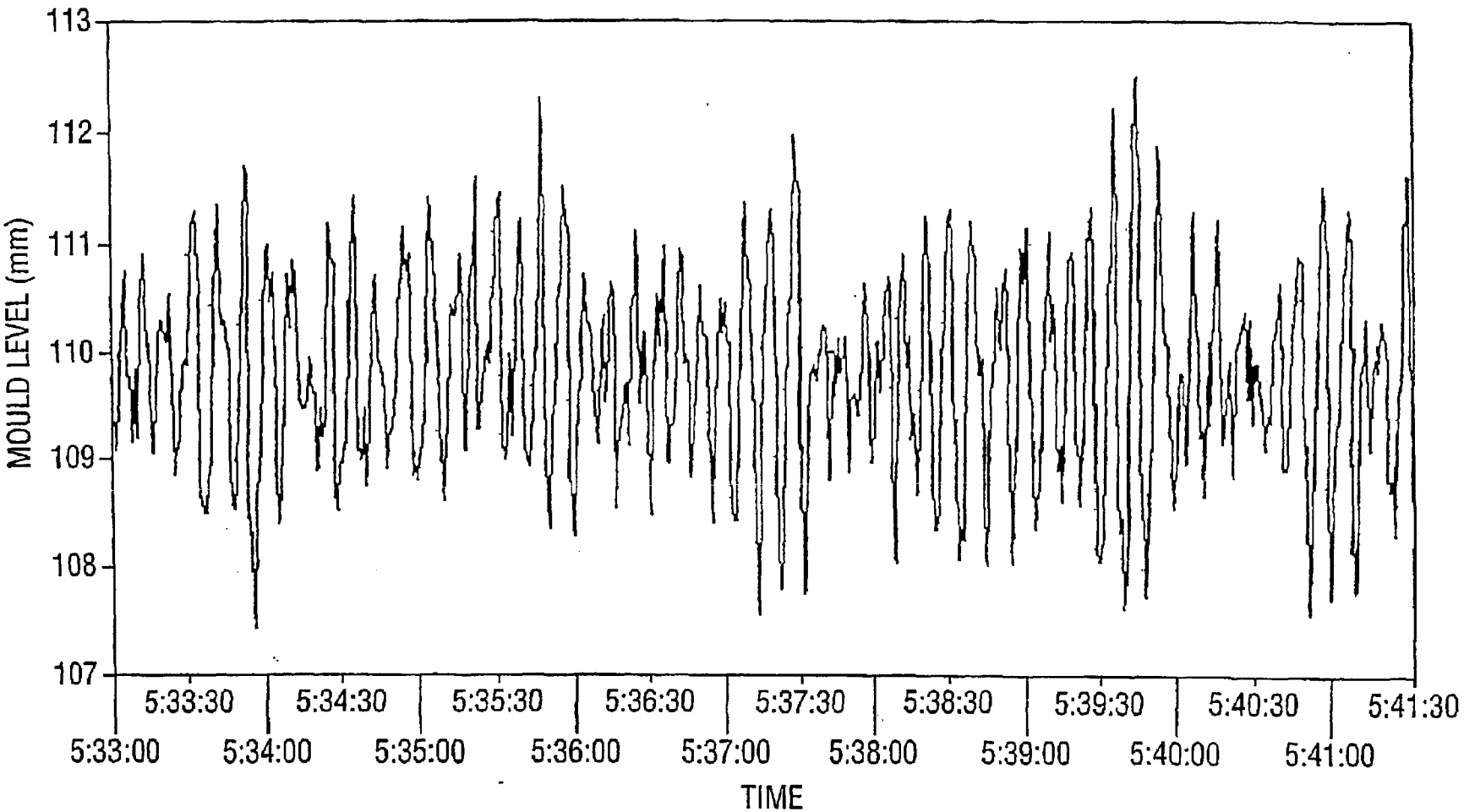
FIG. 1 shows a typical signal from a mould level sensor illustrating the function of mould level versus time.

FIG. 1 shows a sample of mould levels recorded over a period of 512 seconds. The vertical axis of the graph shown depicts the mould level measured and the horizontal axis depicts time elapsed over the monitored period. As can be seen the signal has periodic components.

The inventors have found that a mathematical analysis of the function produced by a plot of mould level against time reveals periodic influences at frequencies which can be correlated with the activities of the rollers. Any significant increase in amplitude of the transformed signal at a particular frequency may be indicative of an irregularity in a roller's behaviour which may be attributable to damage, misalignment or similar problems with the casting machine. For example, a roller which has sustained damage at a point on its circumference so as to affect its rotational symmetry will impart a periodic variation to the strand width passing between that roller and its pair. This periodic influence will be highlighted in the transform generated in step ii) of the method.

The expected frequency of a harmonic for a particular roller at a particular casting speed over the period sampled can be calculated from simple formulae. Any significant increase in amplitude of the transformed signal at a frequency harmonic can provide an indication of the type of damage or other problem with the roller generating that harmonic.

Typically roller diameter and pitch of rollers on a casting machine are designed to be different at different points along the length of the machine to account for variations in the properties of the metal as it cools. Rollers are generally grouped in multiples of similar size and pitch across particular segment(s) of the casting machine. Thus, as well as identifying the occurrence of a roller problem, the method can locate the position of the problem roller to within an identifiable group of rollers of known size and pitch.

The expected harmonic frequency associated with a roller of a particular diameter can be calculated from the simple equation:

$$fd = \frac{Vc}{\pi d}$$

where:

$f_d$ is the frequency of the harmonic in Hz $v_c$ is the casting speed in m/s d is the roll diameter in metres.

It has been observed that the frequency harmonics associated with a particular roll diameter will appear as multiples of the base frequency determined from the above equation. For example, if a roll is significantly warped the frequency may be twice or four times that expected.

Similarly the harmonic frequency associated with a particular pitch between roller centres can be calculated from the simple equation:

$$fp = \frac{Vc}{p}$$

where $f_p$ is the frequency of the harmonic in Hz $v_c$ is the casting speed in m/s p is the roller pitch in metres It will be understood that since each of the above referenced formulae rely on a continuous casting speed for accuracy it is desirable to monitor the casting speed. Conveniently, the apparatus used to implement the method may incorporate an alarm for alerting the system user to a variation in casting speed. Optionally the apparatus may interpolate from periods of constant speed to provide an estimate of roller properties.

The method is conveniently carried out by a computer programme which receives as an input mould level data from a mould level sensor. The sensor may be provided in any suitable form where the signal recorded can be converted into computer readable form. Existing technologies include electromagnetic sensors, radioactive sensors and light sensors. The computer programme may also receive an input related to the casting speed. When stable casting speed conditions are recognised, the programme applies an appropriate mathematical transform to the mould level versus time function to identify underlying periodic influences which relate to roll behaviour. Once the periodic influences are identified the programme may compare the recorded data against the predicted harmonics to locate problem areas.

The method of the present invention is particularly suited to casting of thin or narrow thickness strands where smaller diameter rollers and higher casting speeds are used. A Fourier Transformer utilises binary numbers and the period measured should consist of a binary number of seconds. Typically mould level data taken over a period of 512 seconds of continuous speed casting is sufficient for the method to provide an accurate analysis of machine condition in these applications.

Figure 2:
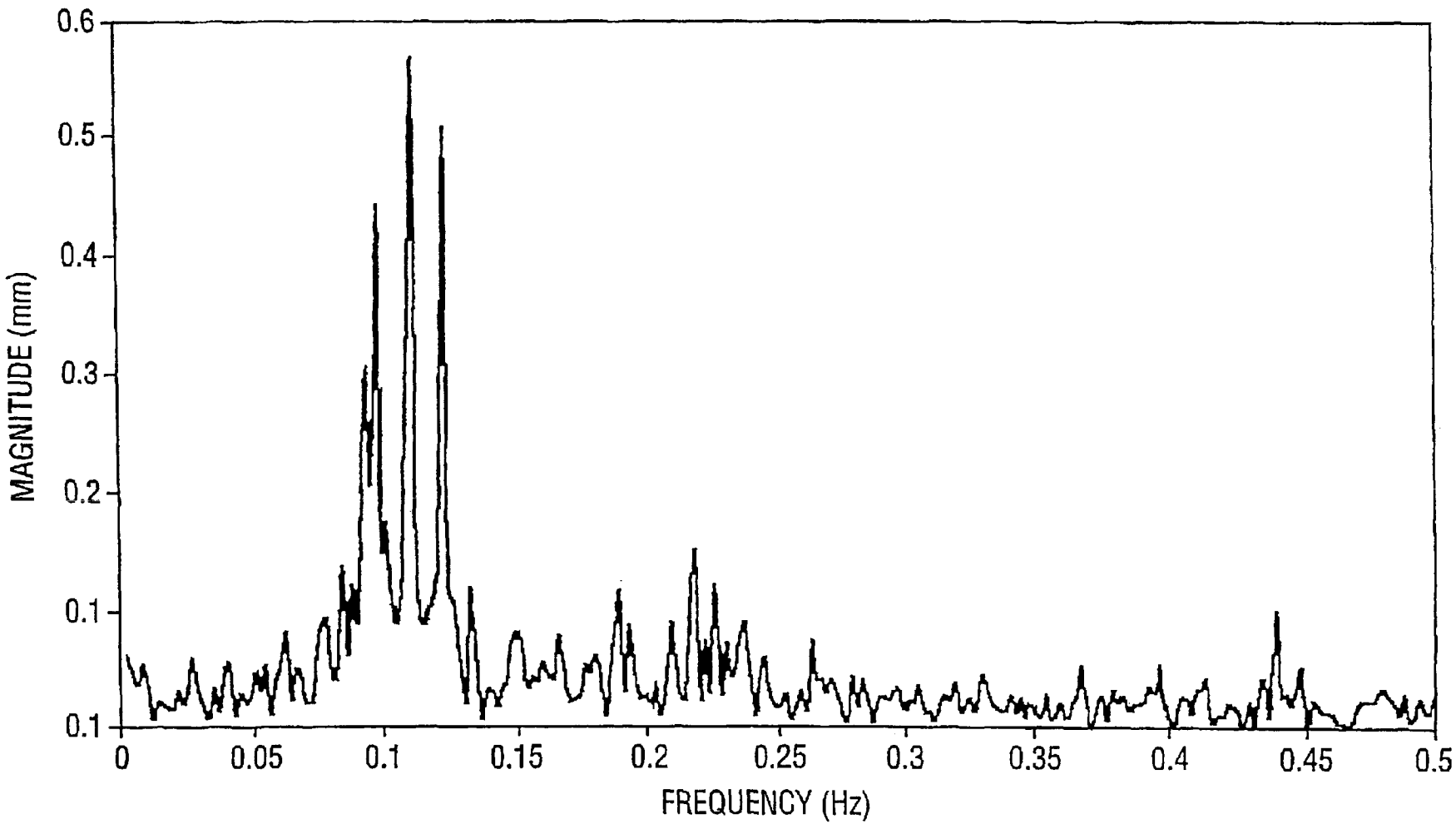
FIG. 2 shows a Fast Fourier Transform of the function of FIG. 1, as determined in step ii) of the method of the invention.

A Fast Fourier Transformation is applied to the mould level versus time function and calculates the simplistic periodic waveforms which can be summed up to obtain the original more complex waveform. Large periodic influences on the mould level signal, such as that which may be caused by damaged or misaligned rollers are highlighted as large peaks in the Fast Fourier transform frequency distribution as shown in FIG. 2. As can be seen a large peak has occurred around 0.1 Hz; this is indicative of an irregularity with respect to a roller.

Figure 3:
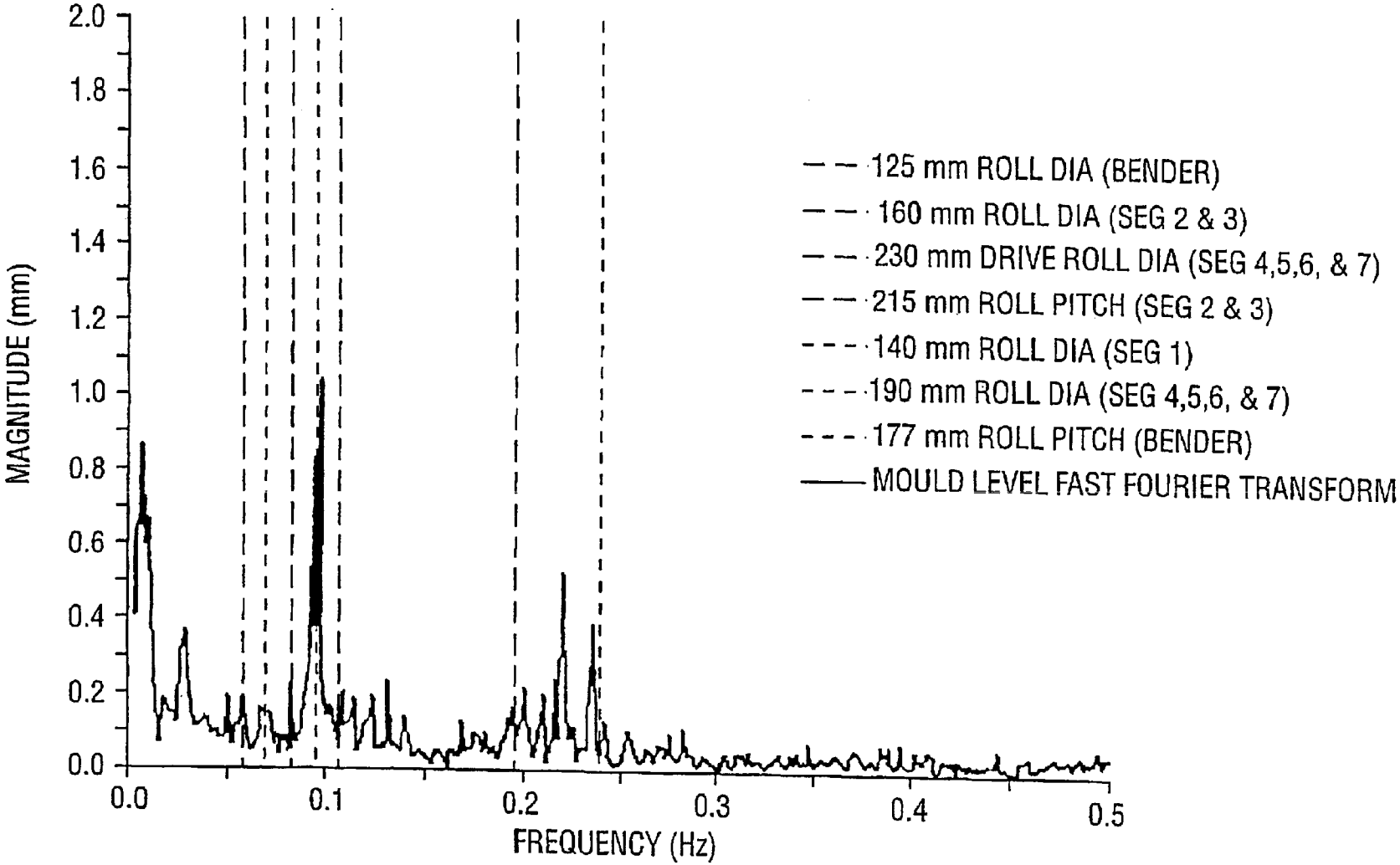
FIG. 3 shows a Fast Fourier Transform for a different mould level versus time function on which has been superimposed predicted frequency harmonics for rollers of known diameter and/or pitch for comparison as described in step iii) of the method of the invention.

The Fast Fourier transform in FIG. 3 again shows a large peak at a frequency of around 0.095 Hz. With the predicted frequencies superimposed onto the transform, an association can be made between the magnitude of the peak which indicates a problem with a roller, and the frequency at which the peak occurs which locates the position of the problem. As can be seen the peak at around 0.095 Hz occurs coincident with the frequency harmonic calculated for the 140 mm roll diameter in Segment 1. Thus it can be deduced that the problem is likely to be with a roller within that segment or segments.

Figure 4:
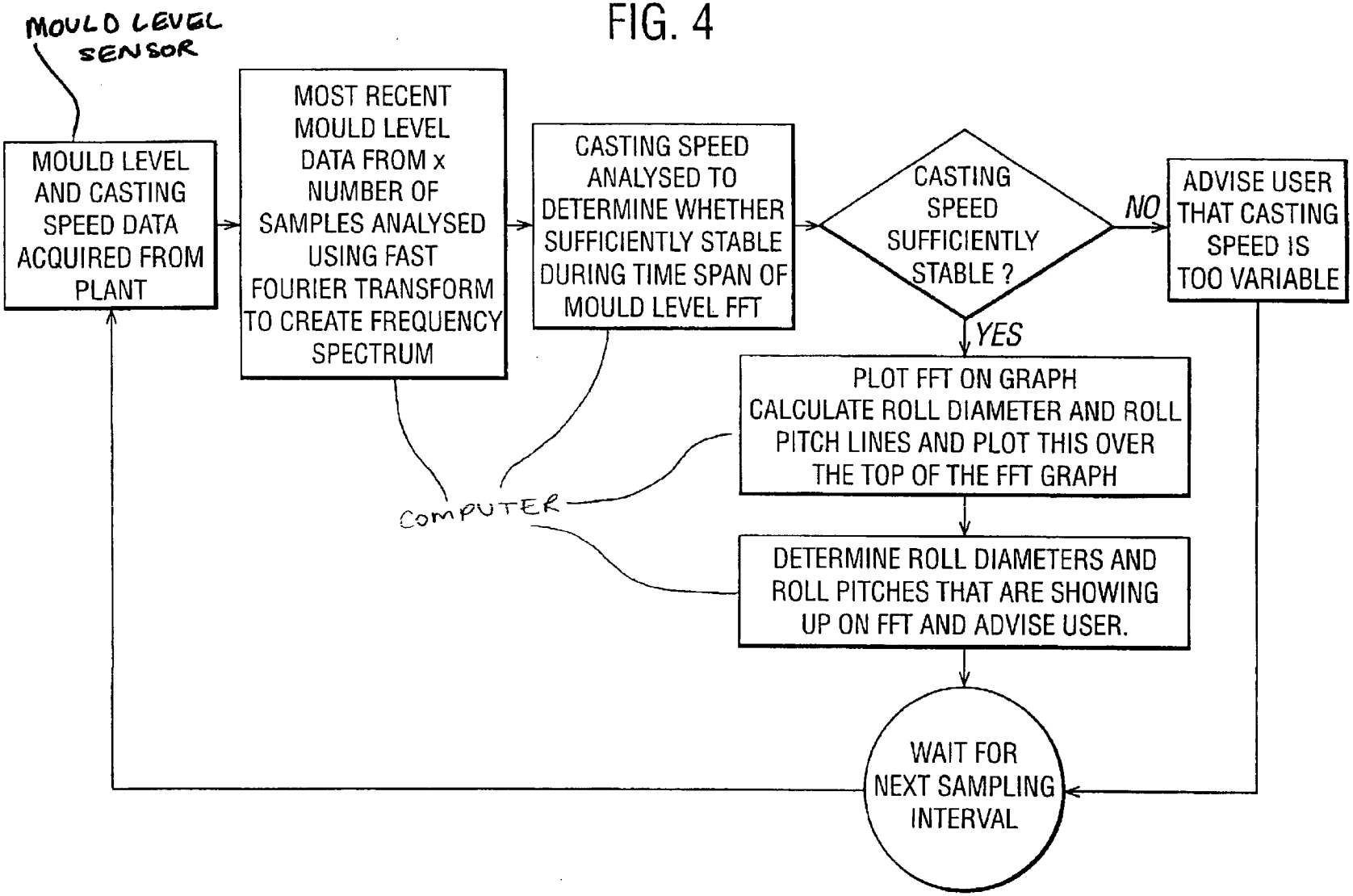
FIG. 4 shows a flow chart for an algorithm for use in performing the method.

FIG. 4 shows a flow chart for an algorithm for use in performin the method.

Mould level and casting speed data is acquired from the plant. The mould level data is then analysed using fast Fourier Transform to create a frequency spectrum.

Next the casting speed is analysed to determine whether this is sufficiently stable during the time span of the mould level Fast Fourier Transform.

If the casting speed is sufficiently stable the fast Fourier transform data is plotted on a graph. The roll diameter and roll pitch lies are then calculated and the data plotted over the top of the Fast Fourier Transform graph. Any roll diameters and roll pitches that show upon the Fast Fourier Transform are determined and the user advised accordingly.

The algorithm then waits for the next sampling interval before returning to the first step of acquiring data from the plant.

If the casting speed is too variable then the user is advised of this, the algorithm then waiting for the next sampling interval before acquiring fresh data from the plant.

The method may be further enhanced by modelling the strand to determine the final point of solidification. As will be understood by the skilled artisan, any segment(s) in the machine which have passed through the final point of solidification are not able to influence the mould level signal and can therefore be ignored in any analysis.

It is to be understood that the preferred techniques described for carrying out the method are purely exemplary and other suitable techniques will occur to the skilled reader without departing from the true scope of the invention which is directed to the on-line detection and location of roller irregularities during continuous casting through analysis of the mould level signal.

What is claimed is:

1. A method for detecting roller irregularities during on-line continuous casting of a metal comprising:

i) continuously monitoring the changes in the mould level over time;

ii) identifying large periodic influences affecting the mould level versus time function and their frequency, iii) comparing the frequency of the periodic influences of step ii) with predicted frequency harmonics based on a normal operation of the casting process and highlighting by comparison of the predicted and actual frequencies characteristics indicative of irregularities in roller behaviour.

2. A method as claimed in claim 1 wherein step ii) involves applying a Fast Fourier Transform to the mould level versus time function of step I).

3. A method as claimed in claim 1 wherein predicted frequency harmonics of step iii) are calculated from the equation:

$$fd = \frac{Vc}{\pi d}$$

where:

$f_d$ is the frequency of the harmonic in Hz $v_c$ is the casting speed in m/s d is the roll diameter in metres.

4. A method as claimed in claim 1 wherein predicted frequency harmonics of step iii) are calculated from the equation:

$$fp = \frac{Vc}{p}$$

where $f_p$ is the frequency of the harmonic in Hz $v_c$ is the casting speed in m/s p is the roller pitch in metres.

5. A method as claimed in claim 1 further comprising monitoring the casting speed and alerting the system user to significant variations in the casting speed.

6. A method as claimed in claim 1 further comprising;

modeling the cast metal strand to determine the final point of solidification and discounting any periodic influences arising from segments in the casting machine which are before said final point of solidification.

7. Apparatus for performing the method of claim 1 comprising:

a mould level sensor and a computer, the computer being provided with a computer programme giving operating instructions to perform the method of claim 1.

8. A computer programme for detecting roller irregularities during on-line continuous casting of a metal, the computer program product comprising:

a computer readable storage medium having computer readable program code means embodied in said medium, said code means comprising:

an algorithm which comprises the steps of:

analysing mould level data using Fast Fourier Transformation to create a frequency spectrum;

determining whether casting speed is sufficiently stable during time span of the mould level Fast Fourier Transform;

informing the user if the casting speed is too variable;

in the event that the casting speed is sufficiently stable plotting a graph of the calculated roll diameter and roll pitch lines over the Fast Fourier Transform; and informing the user of any roll diameters and roll pitches which show up on the Fast Fourier Transform graph.

* * * * *